US007048068B2

(12) United States Patent
Paulkovich

(10) Patent No.: US 7,048,068 B2
(45) Date of Patent: May 23, 2006

(54) FIRE EXTINGUISHING SYSTEM FOR LARGE STRUCTURES

(76) Inventor: Michael B. Paulkovich, 377 Valley Stream Rd., Severna Park, MD (US) 21146

( * ) Notice: Subject to any disclaimer, the term of this patent is extended or adjusted under 35 U.S.C. 154(b) by 175 days.

(21) Appl. No.: 10/624,485

(22) Filed: Jul. 23, 2003

(65) Prior Publication Data

US 2005/0016741 A1 Jan. 27, 2005

(51) Int. Cl.
*A62C 35/00* (2006.01)

(52) U.S. Cl. ..... 169/16; 169/50; 169/60; 169/61; 169/5; 340/578

(58) Field of Classification Search ..... 169/50, 169/16, 23, 61, 5, 7, 60; 340/511, 517, 521, 340/518, 628, 578, 629
See application file for complete search history.

(56) References Cited

U.S. PATENT DOCUMENTS 4,091,874 A 5/1978 Monma
4,351,394 A * 9/1982 Enk ..... 169/61
5,486,811 A 1/1996 Wehrle et al.
6,009,954 A * 1/2000 Phillips ..... 169/16
6,065,546 A * 5/2000 Uetake et al. ..... 169/61
6,263,974 B1 * 7/2001 Sundholm ..... 169/62
6,415,870 B1 * 7/2002 Matsuoka ..... 169/16

FOREIGN PATENT DOCUMENTS

DE 31 32 528 A1 8/1981

* cited by examiner

*Primary Examiner*—Dinh Q. Nguyen
(74) *Attorney, Agent, or Firm*—Foley & Lardner LLP

(57) ABSTRACT

A method and system for detecting and extinguishing fires, and for sharing fire retardant throughout a network of interconnected reservoirs, is self-sealing and autonomous. The system isolates reservoirs when interconnection piping is damaged, and shares retardant to the fire location(s) as needed by routing retardant through undamaged piping segments. Reservoir sensors, fire sensors, damage sensors, valves, redundant and spatially separated flow paths, controllers, and manual over-rides all provide the method and system for detecting and extinguishing major fires automatically, and reacting to system damages. The system is best suited for large buildings or structures such as office buildings, large-scale warehouses, sky-scrapers, cruise ships, aircraft carriers, and the like.

43 Claims, 8 Drawing Sheets

FIRE EXTINGUISHING SYSTEM FOR LARGE STRUCTURES

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION—FIELD OF ENDEAVOR

The present invention generally relates to systems and methods for fighting fires in a protected space, and more particularly, to fighting fires in large structures, buildings, ships, and the like.

BACKGROUND OF THE INVENTION

Fire detection and extinguishing systems for office buildings, warehouses, sky-scrapers, and so forth typically involve fire doors, thermally activated sprinkler heads, extinguishant, and a central control panel to monitor the overall system. For instance, U.S. Pat. No. 4,091,874 to Monma (May 1978) discloses a building-wide system consisting of detectors, warning signals, actuated fire doors, extinguishers, a suction system, a control panel, and timers, to automatically control doors and extinguishers. U.S. Pat. No. 5,486,811 to Wehrle, et. al. provides early detection and extinguishment of fires using, among other components, carbon monoxide sensors, flame detectors, and a central controller that transforms sensor data into a "profile" to correlate that data with known data.

Such inventions strive to optimize fire detection and prevention, but they all exhibit several shortfalls. No autonomous and damage-tolerant methods have been proposed for delivering very large quantities of fire retardant, via a building-wide system of selectably interconnected reservoirs having redundant flow paths, to provide a volume of retardant that can extinguish major fires within a building. On the contrary, fire fighting systems for skyscrapers and office buildings typically strive to minimize redundancy; they are generally incapable of extinguishing very intense fires; and they are not able to autonomously re-route retardant throughout a building or structure to the fire location in reaction to damages within the fire fighting system itself.

For example, some fire detection and extinguishing systems of the prior art utilize the building-wide common water supply for the source of fire retardant. When piping is substantially damaged in such a system, retardant is wasted by leaking at the damage points; and pressure is reduced, thus reducing the volume of water flow where it is needed. As another example, other systems of the prior art utilize discrete extinguishing subsystems, each consisting of its own reservoir and pipes supplying retardant to sprinkler heads. When a fire is detected, and sprinkler heads activate, and then the reservoir consequentially empties, there are no automatic and damage-tolerant means to supply more retardant to the empty reservoir from other full reservoirs.

Accordingly, the new invention being disclosed is an enhancement and advantageous over the prior art, as it detects and controls intense fire in large buildings or structures such as office buildings, sky-scrapers, cruise ships, aircraft carriers, and the like, using a method of retardant distribution and sharing that reacts automatically, not just to fires and the need for a supply of fire retardant, but it also responds automatically to damage to the fire extinguishing invention itself.

BACKGROUND OF THE INVENTION—OBJECTS AND ADVANTAGES

The prime purpose of this invention is to extinguish intense fires within a large structure; and more specifically, to extinguish large fires within the constraints of a degraded fire suppression system, for instance being damaged by earthquake, explosions, and so forth. Several objects and advantages of the present invention over prior art are:

(a) to selectably and automatically distribute and share retardant, supplying retardant via multiple flow paths where needed;

(b) to sense and react to system statuses, such as fire detectors, reservoir levels, and system damage;

(c) to automatically and selectably seal and isolate retardant reservoirs as appropriate;

(d) to spatially separate reservoirs and retardant piping paths so that localized damage to any structure affects the fewest number of reservoirs and piping;

(e) to connect sensors to controllers in overlapping topologies; and (f) in certain embodiments, to use gravity to induce retardant sharing.

As will be shown, the resulting fire suppression invention is thus able:

- to automatically supply very large amounts of retardant to fire areas, by virtue of a plurality of relatively small, interconnected reservoirs throughout the structure to be protected;
- to react automatically to damage and subsystem malfunctions, by virtue of damage sensors and the selectable and automatic sealing and isolation of reservoirs, and due to the several subsystem redundancies and redundant flow paths;
- to suppress fires, automatically or manually, by virtue of fire sensors, reservoir level sensors, retardant valves, and electronic controllers.

Although some descriptions herein contain certain specifics, these should not be construed as limiting the scope of the invention, but as merely providing illustrations of some of the presently preferred embodiments of this invention. For example, the figures depict fire retardant as being a liquid, shared and delivered to the fire primarily by gravity power. Such a configuration was chosen to simplify drawings and explanations. Any suitable retardant type, and any pumping, pressure, or delivery system may be employed. As another example, conducting wires are described for sensors and control signals, with bi-level voltages. However, modulated, multiplexed, networked, fiber-optic, or wireless communication could be used where appropriate. Thus the scope of the invention should be determined by the claims and their legal equivalents, rather than by the examples given.

SUMMARY OF THE INVENTION

In accordance with the present invention, automatic fire detection, and extinguishment thereof, is provided to large structures or protected spaces, with the ability to deliver extensive quantities of fire retardant to the fire location, while automatically compensating for damage to the fire extinguishing system itself. A network, comprising retardant reservoirs, piping, valves, sensors, and controllers, causes automatic extinguishment of fires; shares fire retardant between various locations automatically; and remains substantially tolerant to system damage.

Such automatic retardant sharing, and damage tolerance, are achieved by sensors, system redundancies, selective isolation of subsystems of retardant, various spatial separations, and other design considerations.

Sensors used in the invention include sensors used in standard prior art fire extinguishing systems, such as temperature detectors, CO detectors, and the like, plus various other system status sensors, including reservoir level sensors and piping continuity sensors. These sensors interoperate by way of various electronic controllers and monitors.

The present invention relies on environmental sensing, redundancies, retardant flow and confluency control, autonomous subsystem self-monitoring, spatial separations, and controllers, to achieve the stated goals.

Thus, when fire(s) within the structure occur, this invention detects such fires and supplies fire retardant thereto, as in prior art. Yet moreover, this invention also compensates for damage to the fire extinguishing system itself; and, it allows (by way of retardant sharing), as needed, very large amounts of retardant to be delivered to the fire areas through a network of flow paths, thus allowing substantially intense or large fires to be extinguished.

In some embodiments there is substantial use of gravity to cause fire retardant flow, and in such embodiments, the majority of retardant is located preferably in reservoirs at relatively higher vertical positions within the structure.

BRIEF DESCRIPTION OF THE SEVERAL VIEWS OF THE DRAWING

To illustrate this fire extinguishing invention, a preferred embodiment will be described herein with reference to the accompanying drawings.

DRAWINGS—REFERENCE NUMERALS

| | |
|---|---|
| 10 | retardant reservoir |
| 20 | fire retardant |
| 25 | retardant flow direction |
| 30 | vertical share piping |
| 31 | horizontal share piping |
| 32 | sprinkler piping |
| 40 | vertical sharing valve |
| 41 | horizontal sharing valve |
| 42 | breach valve |
| 43 | sprinkler cutoff valve |
| 50 | extinguisher valve |
| 60 | sprinkler head |
| 70 | reservoir sensor |
| 72 | reservoir annunciator |
| 100 | reservoir empty signal |
| 101 | reservoir empty' signal |
| 102 | reservoir empty annunciator |
| 105 | reservoir empty lamp |
| 110 | continuity wire |
| 112 | discontinuity annunciator |
| 115 | discontinuity lamp |
| 120 | retardant share inhibitor |
| 130 | share request signal |
| 135 | share lamp |
| 140 | share control switch |
| 141 | master share auto select |
| 142 | master share open select |
| 143 | master share close select |
| 144 | inverted master share close |
| 200 | master controller |
| 320 | CO detect signal |
| 322 | CO annunciator |
| 325 | CO lamp |
| 329 | CO detector |
| 330 | over-temperature signal |
| 332 | over-temperature annunciator |
| 335 | over-temperature lamp |
| 338 | ground reference |
| 339 | over-temperature sensor |
| 340 | fire detect signal |
| 341 | fire detect' signal |
| 345 | fire lamp |
| 349 | fire analyzer |
| 400 | building damage monitor |
| 405 | building damage lamp |
| 410 | building damage continuity signal |
| 412 | building damage annunciator |
| 415 | building damage lamp |
| 500 | refill piping |
| 510 | water system |
| 520 | refill valve |
| AG1 | AND gate |
| AG2 | AND gate |
| AG3 | AND gate |
| IN1 | inverter |
| OG1 | OR gate |

DETAILED DESCRIPTION—PREFERRED EMBODIMENT

Figure 1:
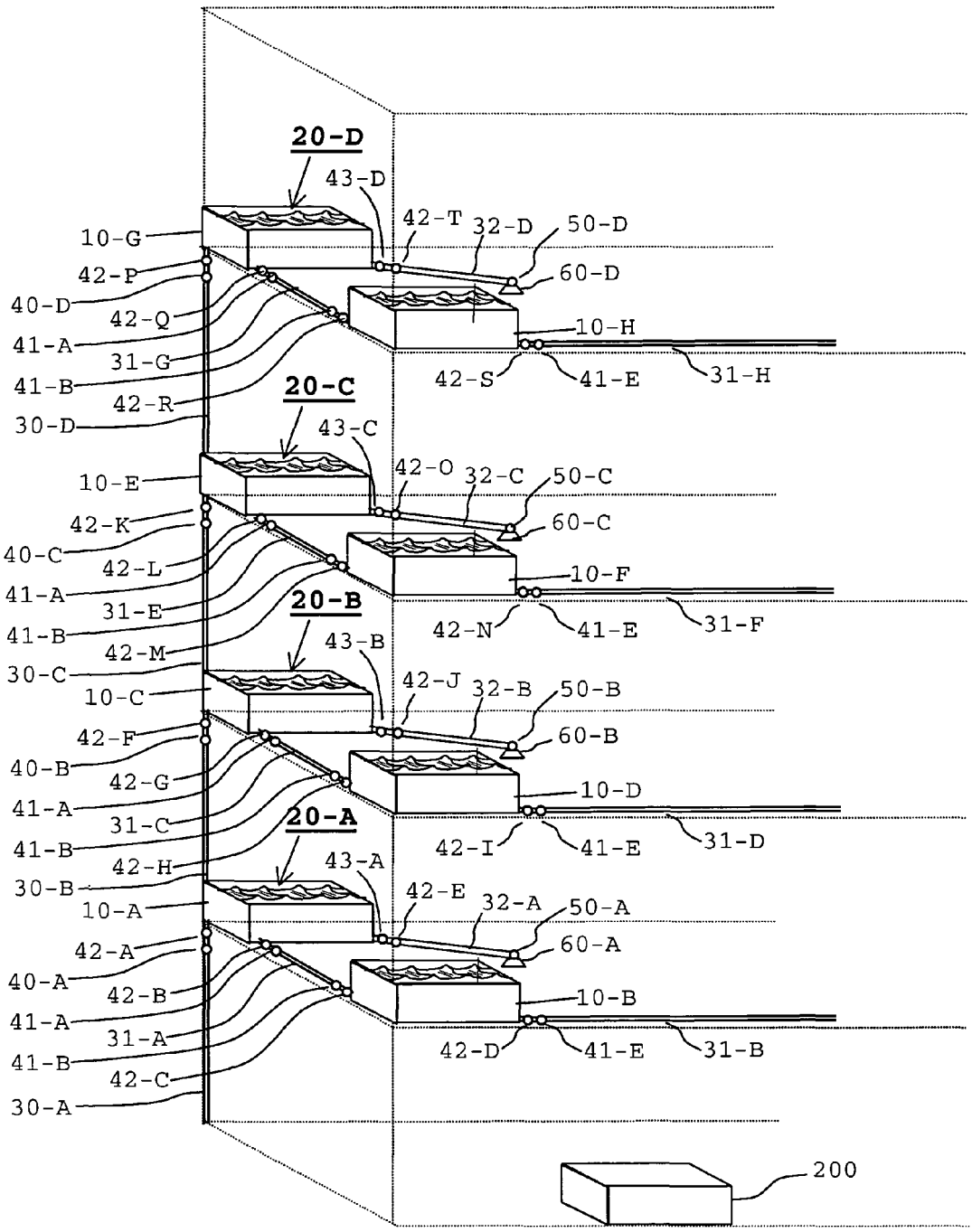
FIG. 1 shows the preferred embodiment, a diagram of part of the invention installed within a large building.

Referring now to the drawings, and more particularly to FIG. 1, there is shown a preferred embodiment of the invention for use in a skyscraper or large vertical structure, to illustrate retardant flow control and fluid interconnections there within. Shown is a plurality of retardant reservoirs 10, each of which contains a fire retardant 20, positioned at predetermined strategic vertical and horizontal intervals within the structure that is to be protected from fire by the invention.

The type of fire retardant used with this system is largely inconsequential, but the figures assume that it is water. The vertical and horizontal intervals for retardant reservoirs should be chosen according to the specific embodiment of the invention, and according to various structural and environmental considerations. The descriptions and figures herein describe an embodiment wherein several retardant reservoirs are placed on each floor of the structure.

Regarding the selected fire retardant, any appropriate single retardant, or combination of retardants, may be used. This includes, but is not limited to: water, dry chemicals, foams, inert gases, powdered aerosols, and halons. Combinations of retardants are advantageous when, for instance, one section of a protected space contains inflammable materials of a substantially different composition than another. As another example, humans may occupy one section (and thus non-toxic retardants are prescribed), and another section has no human occupants. When retardant combinations are used, then clearly separate, isolated piping and reservoir networks may be necessary (depending upon the nature of the retardant combinations). Such separate networks may nevertheless be installed to protect the same protected space, and may share subcomponents such as sensors and controllers.

The retardant reservoirs are interconnected by a vertical share piping 30, and by a horizontal share piping 31. Such piping and reservoirs are redundantly interconnected via paths that are significantly spatially separated. This forms a web-like network of piping that is selectably placed in fluid communication between any desired nodes, via electrically controlled valves. This network of piping is arranged with multiple, or "topologically parallel" flow paths, such paths being substantially separated from one another in space.

"Retardant sharing," or flow of retardant between reservoirs or nodes, can be inhibited or allowed as necessary by a plurality of vertical sharing valves 40, and a plurality of horizontal sharing valves 41. These sharing valves are normally closed; but when opened, they provide fluid communication between reservoirs or nodes. This effectively supplements the volume of retardant suppliable to any lower location, and thus provides substantial retardant where needed.

The default state during operation maintains sharing valves in their closed position, resulting in a "safemode" system: fluid communication between retardant reservoirs is consequently inhibited. Thus, any potentially damaged pipes or reservoirs are not in fluid communication in such state.

A path, or paths, for retardant flow through the plurality of interconnected piping can be selected by opening certain valves, thus allowing sharing of retardant. As will be seen, in the case where there are sections of damaged piping or damaged reservoirs, the present invention automatically routes retardant through undamaged piping when needed, while sealing off flow to damaged areas. Moreover, re-routing and sharing of retardant can also be manually controlled, as will be shown in paragraphs that follow.

With the exception of manually operated valves described in sections to follow, the type of valves used in the preferred embodiment are those typical of prior art that are electrically actuated, moving (fully closing or opening) when a signal or voltage is applied (thus, for instance, actuating a solenoid), and which rest (for example, springably) in a "default state" when voltage is not applied. Unless otherwise noted, all electrically actuated valves used in the invention are "normally closed" to keep reservoirs and nodes independent and safe, in the case of ad hoc damage to other sections. As is otherwise noted herein, certain other electrically actuated valves are of the "normally open" type.

By way of clarification, to provide fluid communication between any two reservoirs or nodes for retardant sharing, an embodiment could conceivably incorporate a single horizontal sharing valve 41, for instance at the middle of a horizontal share piping 31. But in the preferred embodiment, the sharing valves 40 & 41 are configured each as valve pairs, placed at opposite ends of the share piping. This is a very important design consideration: with dual valves at opposite ends of piping, if a share piping is damaged between the valve pairs, the retardant is not emitted, and thus retardant is not lost through the piping leak point. So, in this preferred embodiment, the valve controller must open both of the sharing valves to cause retardant flow between any two connected reservoirs. Further, as will be shown, similar distally opposed valves work in concert with devices that will be introduced such as continuity sensors, to automatically react to piping breaches, and to enable re-routing of retardant flow, as needed, through undamaged piping.

As in typical extinguishers or sprinkler systems, an extinguisher valve 50 actuates when needed, to cause retardant flow from the reservoirs, through a sprinkler piping 32, to a sprinkler head 60, to extinguish the fire. A sprinkler cut off valve 43 shown in the figure is explained in sections and drawings that follow. It is possible to use standard automatic sprinklers of prior art as the sprinkler head 60, for example containing there within the extinguisher valve 50 (which may be the fusible obturator type of prior art, acting as the valve). In such case, flow detectors that are typical in such prior art, and used with fusible sprinkler valves, may be applied as appropriate within the invention, to supply the desired sensor data to various described subcomponents, indicating that a sprinkler valve has been opened (for instance, by flames).

Automatic retardant sharing between different nodes or sections within the structure involves primarily the sharing valves 40 and 41. Automatic fire extinguishing—that is, delivery of retardant to a sprinkler—primarily involves extinguisher valve 50. Control over sharing valves may be automatic, via the sensors and controllers local to the valves, or manual, via a master controller 200; in any preferred embodiment, sharing involves a combination thereof. Figures that follow clarify, and provide examples of such control via the master controller 200, automatic sensors, and other controlling subsystems.

A plurality of breach valves 42 shown in the figure are electrically actuated, and are normally OPEN.

Breach valves are closed automatically when an associated damage sensor indicates there is physical damage to the piping. In the preferred embodiment, the damage sensor for piping consists of a continuity wire 110 (not shown in FIG. 1), such wire being run closely from end to end along and proximate to share piping 30 and 31, and similarly to sprinkler piping 32. Breaking, opening, or grounding of such continuity wire is presumed to be caused by unwanted damage, fire, explosion, and so forth; and thus, integrity of the proximate piping becomes suspect. As such, when any of the continuity wires becomes discontinuous, an "open" (or "floating"), or possibly ground level voltage is sent to the actuating circuitry of breach valve 42, which closes the valve. A non-zero, rather than a ground voltage, is applied at the distal end of all continuity lines, so that any short to ground is detected and interpreted as a breach.

In other embodiments, a "damage sensor" may be any other sensor indicative of physical damage to a component of the system, especially damage to the retardant network, including piping, valves, and reservoirs. Such damage sensors include, but are not limited to, one or more of: flow sensors, pressure sensors, temperature sensors, electrical sensors, cameras, and moisture sensors.

Thus far, piping, reservoir flow, and related valves have been shown, but electrical interconnections and various controllers have not been in the drawings. The interconnections of various controllers and sensors are shown in figures to follow.

Figure 2:
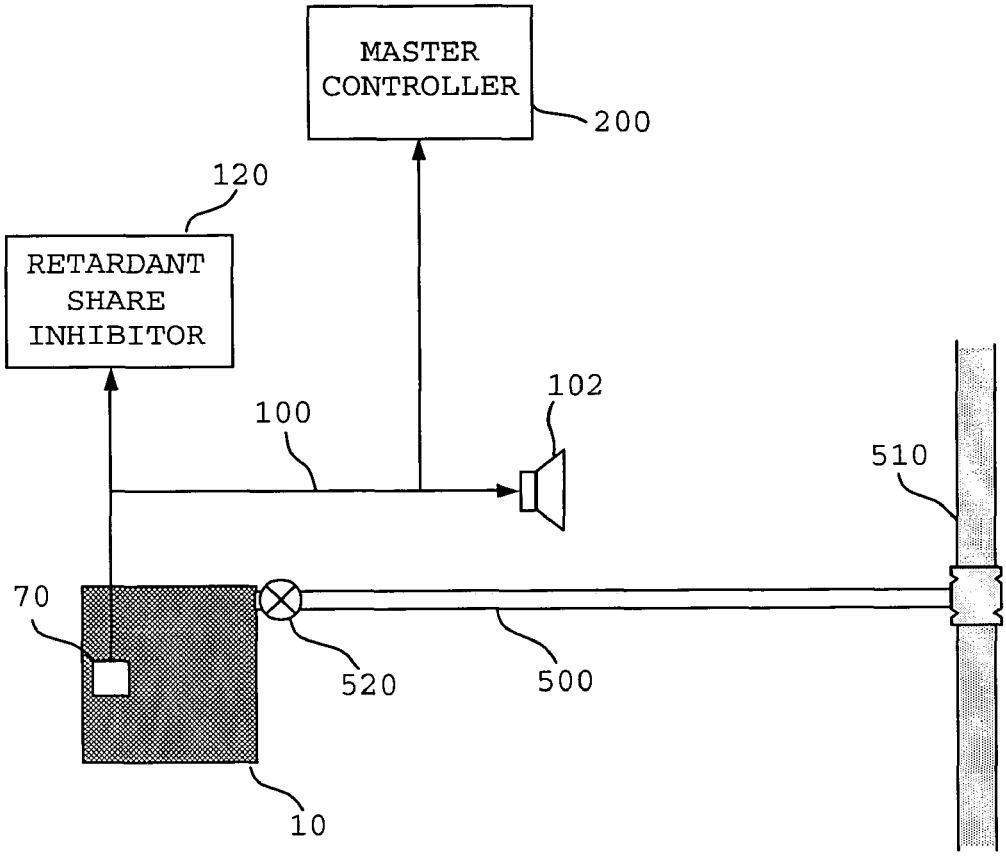
FIG. 2 shows retardant refill interconnections for the case where water is used as a retardant in accordance with the present invention.

If water is used as fire retardant, then initial reservoir fillings, and refilling, are preferably accomplished using the public water system. FIG. 2 shows refill piping 500, which may be placed in fluid communication with a standard (e.g. public) water system 510 for one of the retardant reservoirs 10 when a refill valve 520 is in the open position. The refill valve 520 is preferably a manually operated mechanical shut-off valve, normally kept closed to keep reservoirs in the safe mode. Every water reservoir in the system is connected to the standard water system through sections of refill piping. In this preferred embodiment, the refilling system is kept simple and manual.

Regardless of the type of retardant used, there is a need to refill reservoirs from time to time, for instance due to use of retardant, or minor leaks. A reservoir empty sensor 70 detects such need by raising a reservoir empty signal 100 and thus, among other things, activating a reservoir empty annunciator 102 to alert the user (or building superintendent), and sending a signal to the master controller 200.

To clarify intended uses of system components, the reservoir empty sensor 70 and the empty annunciator 102 work in duality for one purpose to notify the need for maintenance (manual) refilling. However, the reservoir empty sensor also works with other sensors and control signals to provide data that is used for automatic retardant sharing, as will be further explained.

The plurality of reservoir empty sensors are configured such that there is substantial hysteresis in their status reporting. Moreover, they signal "empty" (or better stated, "refilling desired") status when the retardant level has not yet been depleted to the mesial level. For instance, to signal "empty" status when the reservoir is 75% full, and by way of hysteresis, to terminate the "empty" status signal when the reservoir is 90% full.

Figure 3A:
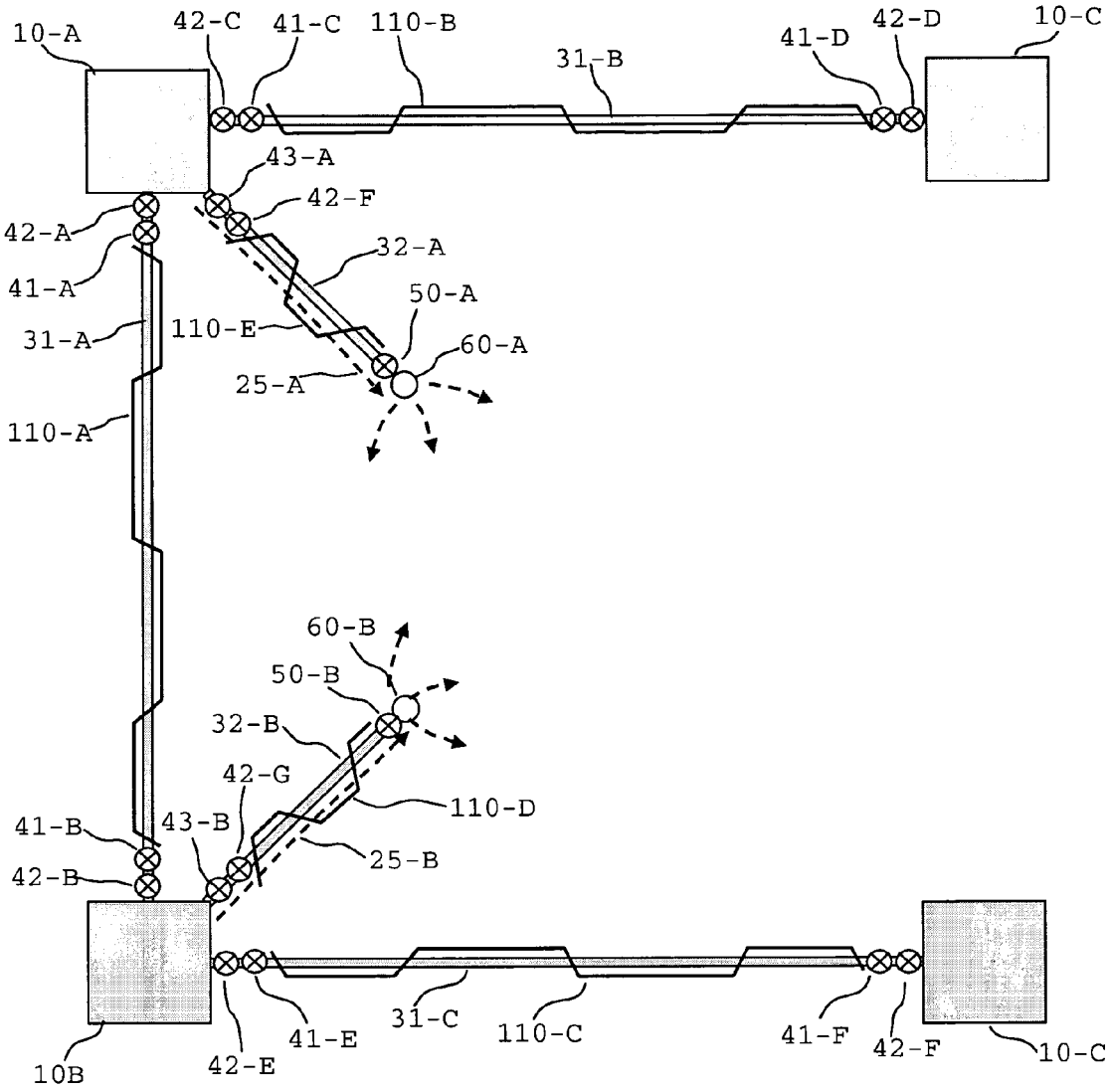
FIG. 3A shows the interconnection of one level (floor) in accordance with the present invention.

FIG. 3A provides an illustration clarifying the interconnection of one typical floor (vertical level) by showing a bird's eye view of one floor of reservoirs, piping, and valves. For simplicity, four retardant reservoirs 10 are shown, and horizontal share piping 31 therebetween. Share piping to other reservoirs on that floor are omitted from the drawing. For any embodiment, the number of reservoirs and their positioning should be considered with scrutiny by building architects and fire control experts.

Pairs of reservoirs are shown in the figure connected via horizontal share piping 31, and they are either isolated or placed in fluid communication depending upon the position of (pairs of) horizontal sharing valves 41 and breach valves 42. Flow of retardant to sprinkler head 60, shown in the figure by retardant flow direction arrow 25, is provided by horizontal sprinkler piping 32, and allowed or prohibited by the breach valve 42, and (manually operated) sprinkler cutoff valve 43. Standard automatic sprinklers of prior art may be used, and thus the extinguisher valve would be located within the sprinkler head. The drawing shows a plurality of continuity wires 110. Interconnections to valves and controllers are detailed in sections that follow.

Figure 3B:
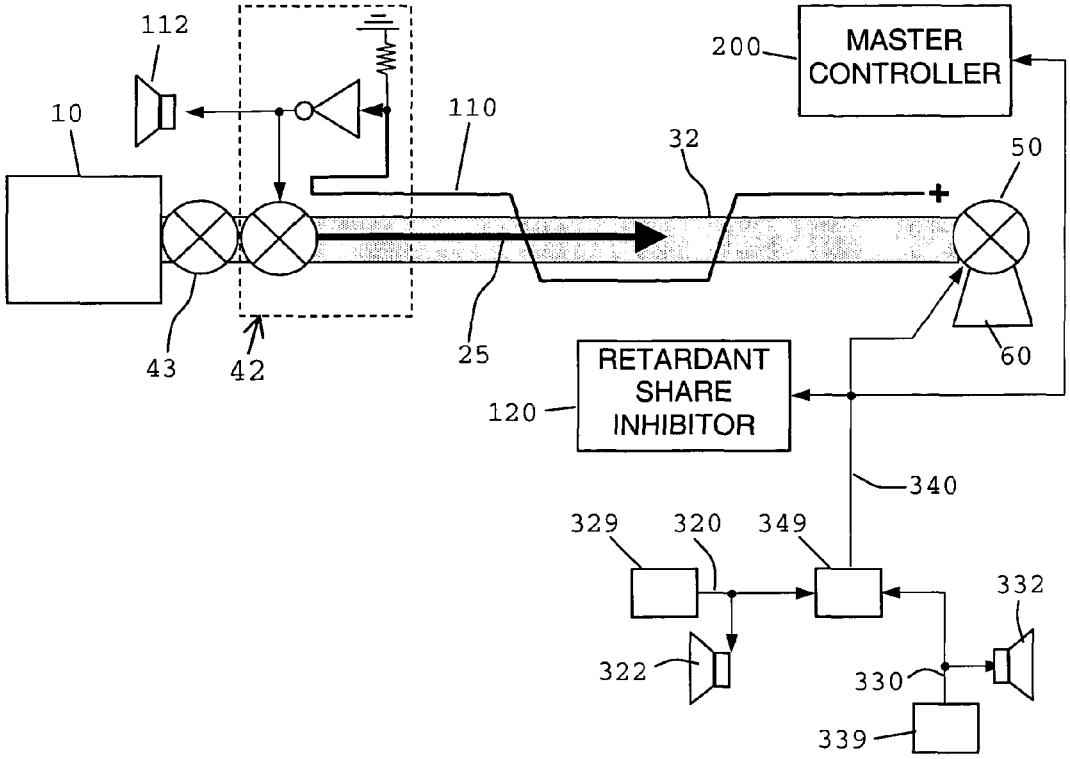
FIG. 3B shows the autonomous controlling of retardant flow to a sprinkler head in accordance with the present invention.

Turning now to FIG. 3B, there is shown therein autonomous retardant flow control from the reservoir 10 to the sprinkler head 60. Retardant must first pass through the sprinkler shut-off valve 43, which is of the manual type valve. During operable deployment, all sprinkler shut-off valves are placed in their open position. In the cases of system tests, false alarms, repair procedures, and so forth, they may be closed. Each breach valve 42, and each sprinkler shut-off valve 43, is located proximate to its counterpart reservoir.

In this figure, an assembly of the breach valve 42 is shown schematically as a "subsystem" of sorts, comprising there within several subcomponents, and some detail regarding control circuitry. Shown therein is a typical electrically-operated valve, incorporating a standard buffer/inverter and pull-down resistor configuration. In this configuration, a simple (DC low-voltage) data signal line is the input to the valve control circuitry, which data signal line is amplified and inverted such that a plus voltage on the low power data signal line (that is, the continuity wire 110) results in a signal to the valve control circuits that results in the default valve position. Specifically, a plus voltage on the continuity wire 110 will result in a ground voltage to the valve actuator (a solenoid), thus leaving the valve springably in its default (in this case, OPEN) position. Because of the pull-down resistor, a break in the continuity wire 110 causes a plus voltage at the valve, and thus results in valve actuation to the opposite (CLOSED) position, sealing the reservoir from the sprinkler piping 32.

FIG. 3B thus illustrates retardant flow control from reservoirs to sprinkler heads. The data signal (a DC voltage from the "+" source shown in the drawing) from the distal end of the continuity wire 110 is used to inhibit retardant flow when the sprinkler piping 32 has been damaged, and also causes discontinuity annunciator 112 to sound when there is a break. The "+" voltage source must have impedance or protection such that shorts of continuity wire 110 to ground are tolerated. Thus, the continuity wire acts, in this case, not specifically to control sharing of retardant, but to prevent leakage at any node within the network of reservoirs when there is damage to sprinkler piping, which reservoirs are possibly in fluid communication when in a "sharing" mode. Other figures illustrate how the plurality of continuity wires is also used to control retardant sharing between other nodes.

An over-temperature sensor 339, and a CO detector 329, act in harmony as fire detectors. In the interest of simplicity in this discussion and drawings, only these two types of fire detection sensors are shown. Depending upon the nature of the structure to be protected and combustibles therein, and along with various cost and complexity factors, additional fire detectors should be employed, such as smoke detectors, IR sensors, and the like. The term "fire detector" as used herein thus refers to any device capable of detecting the presence of a fire, or signs of a fire, such as heat, smoke, carbon monoxide, flames, et cetera.

An over-temperature signal 330 from the over-temperature sensor, and a CO detect signal 320 from the CO detector, are fed as input signals to a fire analyzer 349. (In the example shown, the fire analyzer may comprise simply a logical OR of the two sensor signals. But in other embodiments, several sensor signals may be fed into fire analyzer, requiring a more complex fire analyzer.) The output from the fire analyzer is a fire detect signal 340 that acts as input to the extinguisher valve 50; to the master controller 200; and to a retardant share inhibitor 120. The use of the retardant share inhibitor will be explained in sections and drawings that follow.

Thus, if the sprinkler piping 32 is damaged, the present fire control invention automatically inhibits otherwise wasted retardant flow, using the breach valves and related sensors and controls. Within a network of retardant piping, each extinguisher valve 50 has a dedicated continuity wire 110, being run proximate to the sprinkler piping that supplies retardant to the extinguisher valve, and connected as shown in the figure. By contrast, not every extinguisher valve 50, nor every sharing valve (40 and 41), requires the retardant share inhibitor 120 to be dedicated thereto. As will be shown in sections and drawings that follow, certain sensor data are fed in an imbricate topology from many locations within the structure to each retardant share inhibitor that controls sharing for a predetermined number of associated valves.

The CO detector 329 also activates a CO annunciator 322 disposed locally to the CO detector, when CO is detected. And the over-temperature sensor 339 activates an over-temperature annunciator 332 disposed locally to the over-temperature sensor, when an over-temperature condition is detected.

Fire detection by "profiling" is a prior art method that wherein various sensor data are fed into a profile evaluator, which compares the input data to known profiles stored in memory. The sensor data profile evaluator determines if there have been changes to certain sensor conditions or trends that would indicate, based on known (stored) sensor data, the early stages of a fire. Profile evaluators typically use a combination of various sensor types, such as CO detectors, flame detectors, temperature sensors, and humidity sensors. Fire detection using this method can result in enhanced sensitivity and selectivity (fewer false alarms). The present invention is adaptable to such profiling methods. As will be appreciated by those skilled in the art, such profiling is easily integrated with the aforementioned fire detector subsystem.

The primary purpose of FIG. 3B is to introduce the fundamental principles for retardant flow control to sprinkler heads, and the directly related subsystems. Additional signal interconnections not shown in this drawing are described in the sections to follow. The preferred embodiment thus comprises the essence of all the features, subcomponents, interconnections, and topologies that are presented in the collection of the Preferred Embodiment figures.

Figure 3C:
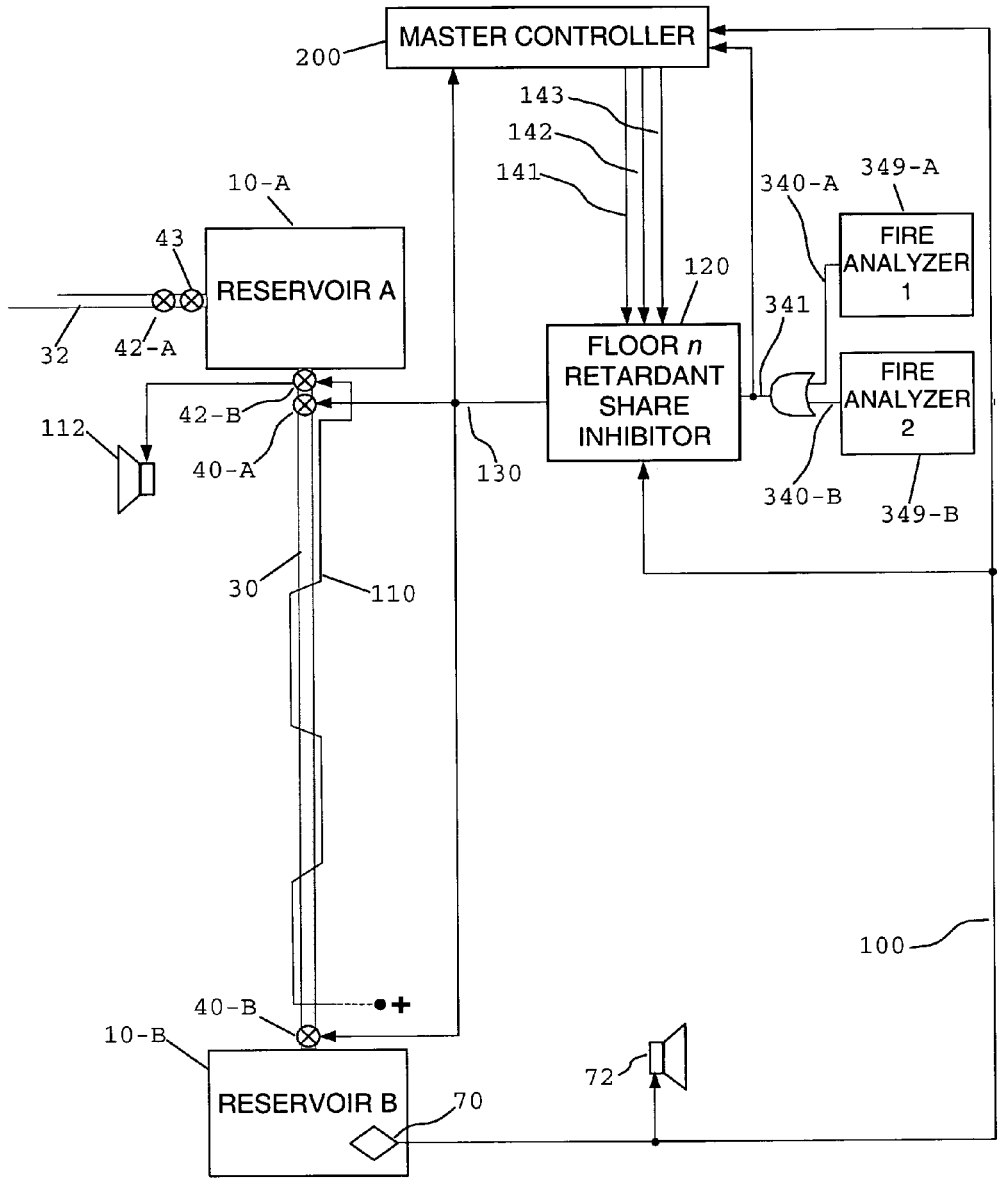
FIG. 3C shows a block diagram of certain subsystems of the invention, illustrating, for the preferred embodiment of the invention, components and interconnections used to sense system status and possible piping damage, and to automatically compensate therefor in accordance with the present invention.

Referring now to FIG. 3C, shown therein are two vertically opposed reservoirs 10 on adjacent floors, and interconnection of sensors and electronic signals to monitor fire, reservoir levels, and to detect and react to system damage. In the configuration shown, breaches to the vertical share piping 30 are tolerated between the two reservoirs and vertical sharing valves 40, because the continuity wire 110, which is run proximate to the share piping, detects such damage and causes the breach valve 42 to close. This placement of the continuity wire is chosen so that damage to the share piping also results in damage to (or grounding of) its counterpart piping continuity wire 110.

The details of the signal communications are largely not critical to operation of the invention, but it is preferable that the master controller 200 is able to manually override some automatic valve control, and that sensor information be provided to the master controller to be used for panel status lights and annunciators. The figures show all signals as hard-wired to master controllers in the preferred embodiment. Such a configuration is not mandatory and should be chosen as each situation dictates. Alternate configurations (for instance transmitting sensor signals to the master controller via radio waves) have certain advantages. The master controller is discussed in more detail in sections and drawings that follow.

The signaling means discussed and illustrated in the preferred embodiment conveys data or information from one component to another through electrical wires, supplying a "True" or "False" signal state (positive or ground voltage), to: indicate a sensor's status; or to control a component; or both. Thus, the signaling means is a method of control, or a method of communicating data or information.

In other embodiments of the present invention, the physical communicative elements for such signaling may be chosen from among any appropriate configuration. This is typically called the "physical layer" and the "datalink layer." Similarly, any number of transforms, modulators, encoding schemes, or protocols may be chosen to implement a higher level of a signaling means, when desired. This generally relates to what is called the "network layer" or "transport layer." Such terminology is largely idiomatic of contemporary electronic communications protocols. Nevertheless the terminology serves to convey the generic meaning that any sort of signaling means consists of something physical (for instance, a wire, or a hydraulic line), and possibly a "higher level" of modulation or language (for instance, frequency modulation, or a protocol such as TCP/IP).

Such elements for the physical or datalink layers include, for instance: wires; optics; radio waves; hydraulics; gears; linkages; and combinations thereof. Appropriate network or transport layer transforms for electrical signaling include, for instance: bi-level voltages; analog voltages; analog modulation; digital encoding; multiplexing; packetizing; and combinations thereof.

An appropriate signaling implementation for the present invention is a combination of: electrical wiring with bi-level voltages; an Ethernet LAN; manual switches; electronic gates; and wireless Ethernet. Typically at the receiving end of such signaling are the subcomponents such as: valve circuitry and related solenoids; status indicator lamps; warning annunciators; video screens; and controllers. When constructing any embodiment of the present invention, many factors—such as environment, reliability, feasibility, and cost—come into play. As such, the choice of signaling means, as well as other design choices, should be scrutinized.

The figure shows how the retardant share inhibitor 120 for each floor can be placed in manual or automatic mode via three control signals: a master share auto select 141, a master share open select 142, and a master share close select 143. The retardant share inhibitor processes those control signals, as well as sensor signals, such that in the automatic mode, sharing is not allowed unless a fire is detected and piping integrity is apparent. In the manual mode, sharing valves (40 or 41) controlled by the retardant share inhibitor 120 may be manually opened or closed by the operator at the master controller 200.

Also shown in the drawing are a plurality of fire analyzers 349. A TRUE signal from any fire analyzer causes a TRUE input signal to retardant share inhibitor 120. This is illustrated in the figure by an OR gate that collects the plurality of the fire detect signals 340, forming one signal sent to the retardant share inhibitor (and master controller 200), a fire detect' signal 341. In a typical embodiment, including the preferred embodiment, each floor has a plurality of fire analyzers. Moreover, as will be shown in figures to follow, each retardant share inhibitor is similarly provided sensor data from a collection of floors below.

When the retardant share inhibitor 120 asserts TRUE on a share request signal 130, it the opens the sharing valve(s) 40, and also sends that share request signal to the master controller 200 (for status display purposes). Retardant will thus flow, and will be shared to the next node (in this figure, "RESERVOIR B"), if the breach valve 42 is also open, as controlled by the continuity wire 110.

In this preferred embodiment, the continuity wire 110 is electrically connected at its distal end to a voltage source (shown by the "+" in the drawing), to supply a non-ground voltage when continuity is intact (when the vertical share piping 30, which is in close proximity, is apparently functional).

Whereas FIG. 3C shows circuit interconnections and piping for sharing between reservoirs that are vertically opposed, and thus shows "vertical retardant sharing," similar interconnections are used for horizontal retardant sharing. Moreover, for horizontal piping, and for certain vertical piping (such as in a pressurized system), the sharing valves (40 or 41) are configured as distal pairs, placed at opposite ends of the share piping, each valve in such pair being simultaneously controlled by the share request signal 130.

For the sake of introducing certain components and their interconnections, this FIG. 3C is a simplified version of a section of the invention. In both the vertical and horizontal cases, actual interconnection of signals from sensors connected to any retardant share inhibitor 120 must be multiply imbricate, connecting a predetermined number of sensors from adjacent floors (or adjacent horizontal locations) to vertically superior retardant share inhibitors. Such overlapping topology is explained in more detail in paragraphs that follow.

Two comparative terms, "vertically superior," and "vertically subordinate" will be used herein to refer to the flow possibilities for retardant. In a simple unpressurized (or gravity-powered) system, flow is basically either horizontal, or downward, and hence for a reservoir on a particular floor, all piping below that floor is considered vertically subordinate. Horizontal flow is similar in nature (due to inherent pressure in reservoirs caused by gravity), and hence all horizontal share piping connected to a reservoir is also referred to as vertically subordinate. The counterpart term "vertically superior" refers to the opposite state; for instance, a reservoir on the 20th floor is vertically superior to piping in fluid communication with it on the 19th floor and all floors below.

In alternate embodiments using a pressurized system, retardant flow may be upward. As such, depending upon the pressure, the nature of the retardant, and the magnitude of the retardant confluency network, the terms "vertically superior" and "vertically subordinate" may have no meaning, or may be differently defined. Thus, retardant flow characteristics in any such alternate embodiment must be taken into consideration.

Figure 4A:
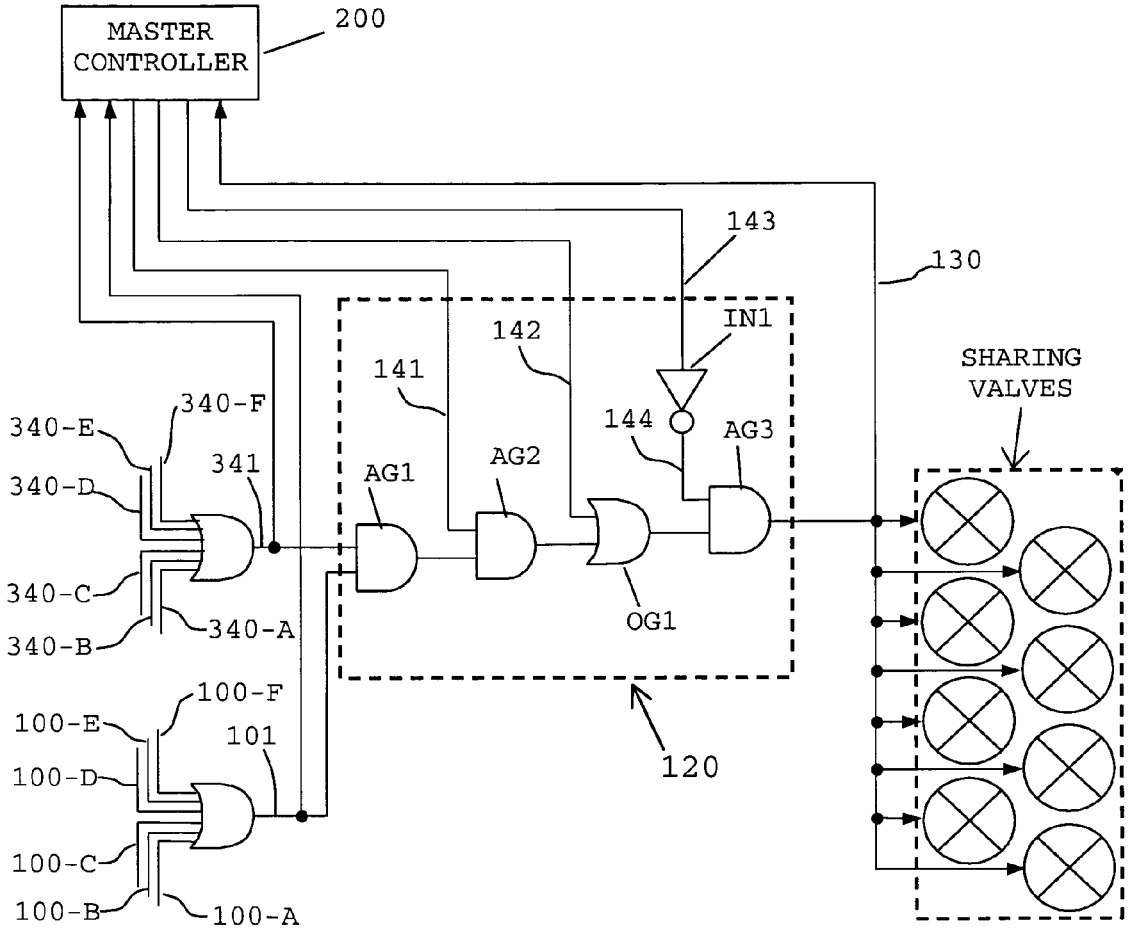
FIG. 4A shows a schematic circuit diagram for implementing automatic fire retardant sharing in accordance with the present invention.

FIG. 4A shows a schematic circuit diagram of the sensor signals and control signals used by the retardant share inhibitor 120; processing thereof within the share inhibitor; and the control signal generated therefrom. A plurality of such retardant share inhibitors is employed in this invention (typically one per floor), to control the plurality of associated vertical sharing valves 40 and the plurality of horizontal sharing valves 41. The circuit of FIG. 4A, when placed in auto-mode by the master controller 200, asserts a TRUE (plus voltage) on the share request signal 130, to open the plurality of sharing valves (normally, all horizontal sharing valves on that floor, and all vertical sharing valves connected to the floor below) when sharing is desirable. Sharing is deemed "desirable" when there are both a presence of a fire indication, and a partially empty reservoir, at a subordinate floor. It asserts a FALSE (ground voltage) otherwise, keeping sharing valves closed. However, the ability to intervene autonomous operation is desirable in such a system, and therefore, this invention provides manual override by the master controller, to allow the user (for example, building superintendent) to open or close sharing valves manually. Regardless of autonomous or manual mode, the continuity wire and breach valve prohibit retardant sharing through flow paths where damage is detected, as described earlier and shown in previous figures.

The controllers and valves thus react to the various sensors, to intelligently open sharing valves when needed and when piping is undamaged, and to seal and isolate retardant flow when sharing is not needed or when piping integrity is breached.

As shown in FIG. 4A, the plurality of fire detect signals 340-A through 340-F, each of which comes from separate fire analyzers (not shown in this figure) are combined (logically ORed) to provide a fire detect' signal 341, a first input into the circuitry of the retardant share inhibitor 120. For simplicity, only six fire detect signals are shown in this figure; but the number of fire analyzers on each floor, and the depth of inter-floor imbrication, may be chosen differently. The fire detect signals serve to close sharing valves when there is no evidence of fire. A plurality of reservoir empty signals 100-A through 100-F are similarly combined to provide a reservoir empty' signal 101 to indicate the need for retardant sharing. An AND gate AG1 logically ANDs the fire detect' signal 341 with the reservoir empty' signal 101. The resultant signal is input to an AND gate AG2 along with the master share auto select 141. The output signal from the AND gate AG2 is input to an OR gate OG1, along with the master share open select 142. The output from the OR gate OG1 serves then as input to an AND gate AG3 along with an inverted master share close 144, which is obtained by passing the master share close select 143 through an inverter IN1. The output of the AND gate AG3 forms the share request signal 130, which is fed directly to the master controller 200, and to the plurality of sharing valves under control (40 and 41), such sharing valves typically comprising all horizontal sharing valves for that floor, and all vertical sharing valves providing flow to the next floor below.

The present invention thus inhibits retardant flow that would be undesirable, unneeded, or wasted, in the case that, for instance: piping is damaged (signaled by the continuity wire); or if there is no apparent fire (signaled by the fire analyzer); or, if there are no retardant-receiving reservoirs that need replenishing (signaled by reservoir sensors).

To simplify figures and descriptions, a simple form of data signal communication (one wire) has been shown. In most cases, is preferable to use a more robust interconnection scheme, for example running both the signal wire and a ground reference wire.

Figure 4B:
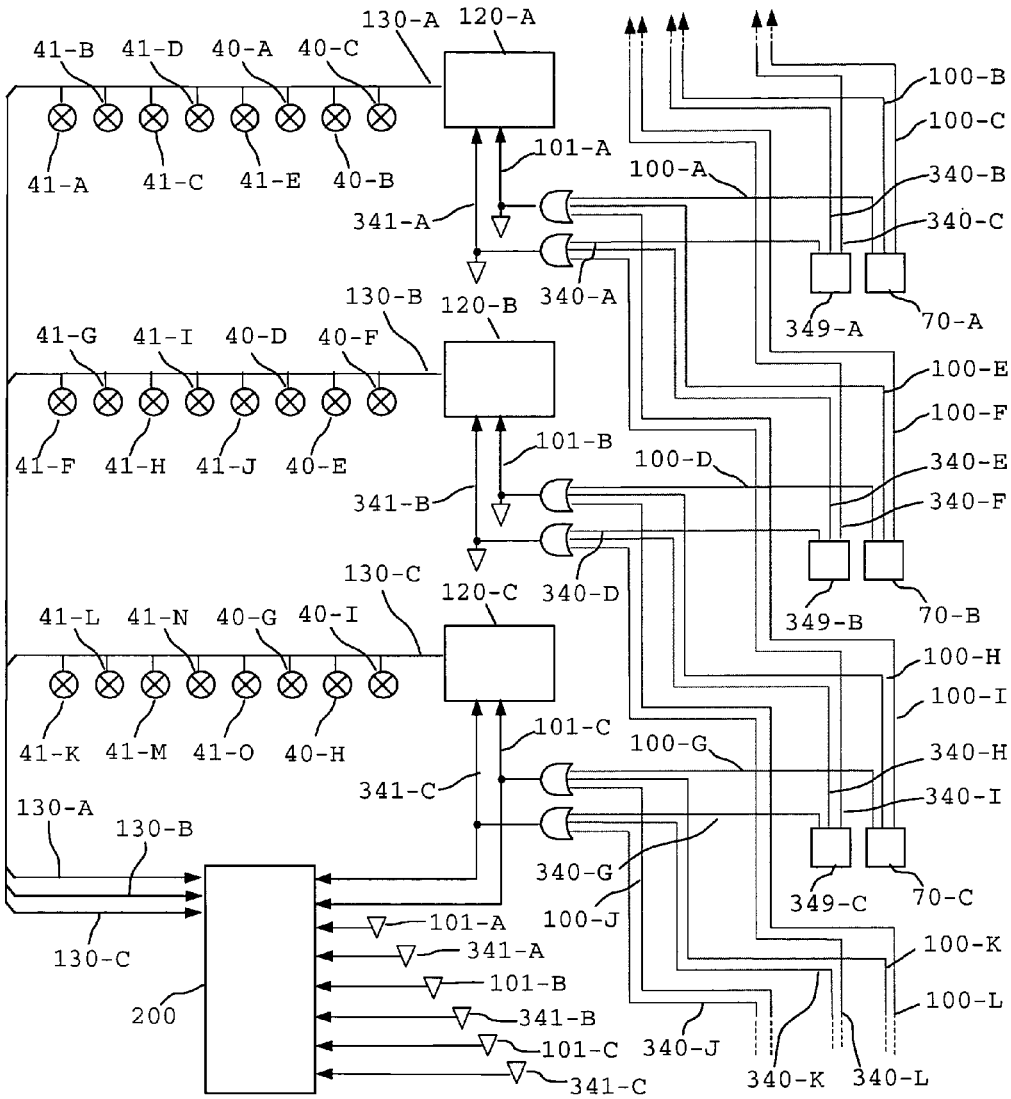
FIG. 4B illustrates the manner that sensor data is collected from a substantial number of floors below each unit that controls retardant sharing to those floors in accordance with the present invention.

Referring now to FIG. 4B, the multiply imbricate sensor interconnections are shown therein. Multiply imbricate sensor interconnections represent an important design consideration for this invention. Yet, in a structure of the type of a skyscraper or large ship, for example, there are so many sections and floors, that 100% building-wide connectivity of sensors and controllers is typically not desirable. The ideal situation is to implement a sensing topology that is imbricate between many floors, and cascaded such that, for any given vertically superior floor, fire sensing data and reservoir empty data are provided from a predetermined number of vertically subordinate floors. That is to say that, in the context of the present invention, for each floor, there are multiple sensor inputs to the retardant share inhibitor 120 for that floor, such sensor inputs being "ganged" (logically ORed) from a large number of floors or sections that are vertically subordinate to that retardant share inhibitor 120.

This sensor system thus provides retardant sharing between many floors and nodes when sharing is desirable and when the share piping is functional; but it inhibits sharing when sharing is not needed, inhibiting flow through any pipes that are breached. The need for retardant at fire(s) below any particular share inhibitor 120 will cause multiple selected sharing valves to open. Web-like fluid interconnection results, causing flow through undamaged piping to the source of the fire(s).

Thus the drawing FIG. 4B shows just such an overlapping and imbricate sensor arrangement. The vertical positions of the sensors shown on the drawing generally correspond to vertical positions of actual sensors within the structure, the top of the page representing higher floors. For the sake of simplifying this drawing, inter-floor imbrication is shown as three floors deep. However, in a preferred embodiment, optimal imbrication depth should be chosen depending upon the structure's architecture, type of fire threat, and cost-benefit analyses. A typical inter-floor imbrication depth is 10 to 30 floors.

A limited, rather than "pan-building" imbrication depth, constrains the extent of automatic retardant sharing within the fire extinguishing invention, which is often desirable due to pressure constraints. For instance, depending upon the retardant and fire-suppression system in question, too many pipes placed in fluid communication may cause rupture due to combined weight (and thus pressure) of retardant.

As shown in the drawing, the plurality of reservoir empty signals 100, supplied from a predetermined number of vertically subordinate floors, are combined (logically ORed), the output therefrom being the reservoir empty' signal 101. Similarly, the fire detect signals 340 are supplied from subordinate floors and are combined to form the fire detect' signal 341. Those combined signals, 101 and 341, are fed into the retardant share inhibitor 120 for that floor, and to the master controller 200. Each fire detect signal 340 is also fed into the extinguisher valve 50 that is assigned to protect the area of the fire detection sensor (not shown in this figure, but shown in FIG. 3B).

This drawing (FIG. 4B) is intended primarily to show the sensor interconnections and imbrication thereof, in the case of vertical retardant sharing control. Similar control and interconnection of horizontal sharing are also incorporated for structures of substantial horizontal extent, such as large ships or underground mines; and sensor imbrication should be employed as applicable. Thus, sensor interconnections of a similar arrangement along the horizontal plane are also used for horizontal sharing, the imbrication depth and topology being chosen depending upon circumstances. In the typical embodiment, this forms a three-dimensional sensor plexus with multiple overlapping inputs to each of the retardant share inhibitors 120. Each retardant share inhibitor in turn controls both a plurality of horizontal sharing valves for the floor where it resides, and the plurality of vertical sharing valves to the next floor below.

Thus, reservoirs and piping, reticulated throughout the structure with multiple possible flow paths and with substantial spatial separation, form a fluid network to provide the infrastructure for retardant sharing and flow to sprinkler heads. The imbricated interconnection of sensor data sent to valve controllers, from adjacent locations on the same floor, and from many floors below each retardant share inhibitor, automatically causes selected sections of the piping plexus to be placed in fluid communication when needed. Moreover, each segment of piping is self-isolating when damaged, due to the continuity wire 110 and the corresponding valves.

Figure 5:
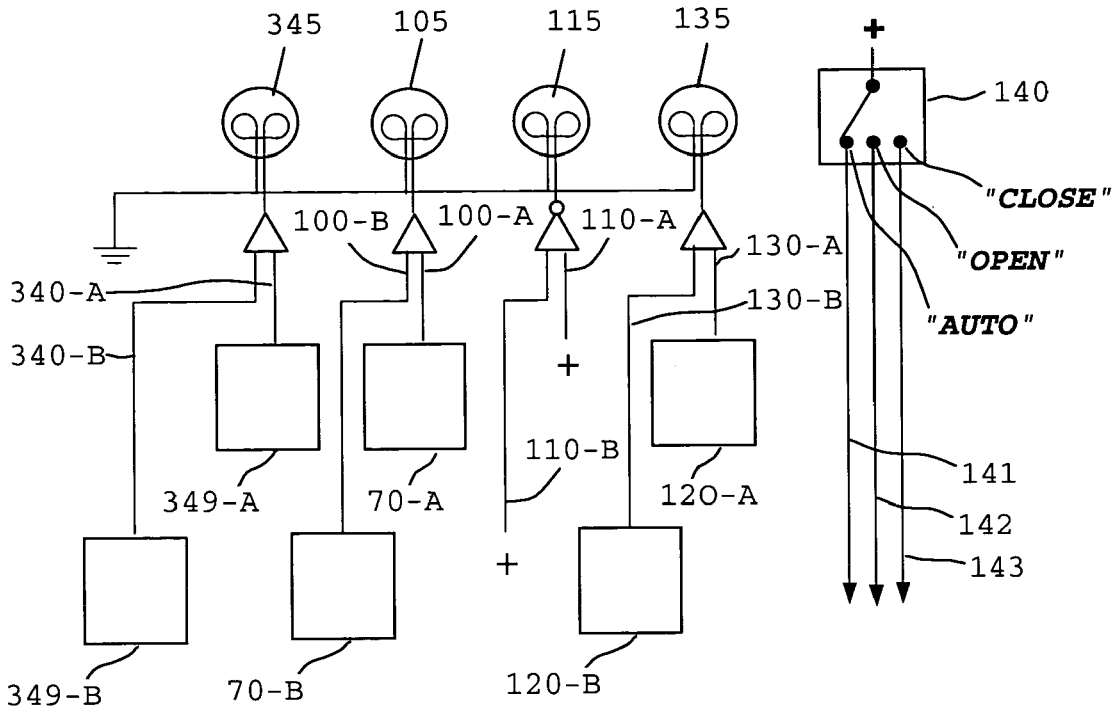
FIG. 5 is a circuit schematic showing master control panel interconnections in accordance with the present invention.

Referring now to FIG. 5, there is shown therein a circuit schematic diagram of interconnections of sensor lamps and valve control switches for the master controller 200. Sensor data is shown in this figure displayed for one floor. The master controller is comprised of a plurality of such set of such status indicator lamps and switches, one for each floor.

As with circuits previously described, bi-level voltages (plus or ground) are indicated, and buffers and pull-down or pull-up resistors are used as appropriate. Referring to the figure, there is a plurality of sensor lamps for the floor, and a share control switch for each floor. Each floor's sensor lamp illuminates based on sensor inputs as follows:

- a fire lamp 345 illuminates when the fire detect' signal 341 is raised for that floor;
- a reservoir empty lamp 105 illuminates when the reservoir empty' signal 101 is raised for that floor;
- a discontinuity lamp 115 illuminates when the continuity wire 110 is breached for that floor;
- a share lamp 135 illuminates when the share request signal 130 is raised for that floor.

In any preferred embodiment, when any sensor lamp illuminates for any floor, an annunciator is also activated (not shown in the figure) to alert the user audibly.

Referring still to FIG. 5, a share control switch 140 allows the user to control the mode of operation for retardant sharing for any particular floor or segment of the piping network. In the figures, segmentation is shown on a floor-by-floor basis, but other configurations are valid.

Selecting "AUTO" on the share control switch for a particular floor asserts TRUE on the master share auto select 141 transmitted to that floor, and FALSE on the master share open select 142 and the master share close select 143. This setting places the retardant share inhibitor for that floor in automatic mode. Selecting "CLOSE" for a particular floor asserts TRUE on the master share close select 143, and FALSE on the master share auto select 141 and the master share open select 142. This setting overrides the retardant share inhibitor for that floor, closing all related sharing valves. Selecting "OPEN" for a particular floor asserts TRUE on the master share open select 142, and FALSE on the master share auto select 141 and the master share close select 143. This setting overrides the retardant share inhibitor for that floor, opening all related sharing valves.

Operation

The manner of using this fire extinguishing invention is similar to fire extinguishing systems of prior art. First, the retardant reservoirs must be filled. In the case where water is used, this involves placing refill valves 520 in the open position until reservoirs are adequately filled. The reservoir empty signals, and annunciators, aid the user in this process. Depending upon the embodiment of the invention, manual valves such as sprinkler cutoff valves 43 may be best left closed during refilling operations.

The refill valves should then be placed in the closed position. An appropriate settling time should be allowed to elapse. Thereafter, any indication of empty reservoirs, signaled on the master controller by reservoir empty lamps, or by reservoir annunciators local to reservoirs, probably indicates leaking that should be repaired.

The share control switches 140 on the master controller may be used to test piping networks and retardant sharing. Other standard tests, common with fire suppression systems of prior art, are also advised, such as verification of interconnections, testing of the fire detection sensors, piping tests, operation of the extinguisher valves and sprinkler heads, etc.

The plurality of share control switches 140 on the master controller should be placed in AUTO mode when the system is ready for use. Thereafter, occasional maintenance refilling may be signaled by reservoir empty annunciators (for instance, due to small leaks), which should be attended to accordingly. The share control switches are useful for manual override of valves during system maintenance and testing. Note that, because of the breach valves, the system inhibits retardant sharing flow when there is an OPEN ("breach") condition on any of the continuity lines 110 associated to piping controlled by those sharing valves, even if sharing valves have been manually opened.

When any warning lamp illuminates on the panel of the master controller, it may indicate a sensor malfunction, or actual warning condition, and the operator at the master controller must ascertain the cause. For instance, when a share lamp 135 illuminates, and yet the associated fire lamp 345 and reservoir empty lamp 105 are not illuminated, the operator may suspect a malfunction, because sharing should only occur automatically when there is a fire detected, and when there is an empty reservoir, due to the configuration of the retardant share inhibitor 120. (Normal operation in the case of a fire shows a fire lamp first illuminating, with possible subsequent indication of reservoir empty, and retardant sharing.)

If a discontinuity lamp illuminates on the panel of the master controller, it may be due to a failed continuity wire, or due to actual piping damage. Illumination of multiple discontinuity lamps is likely an indication of a catastrophic damage to the building, due to explosion, earthquake, et cetera.

Thus the indicator lamps on the master controller provide the operator with a means to assess the extent of fire, damage, and fire extinguishing system operation, and possible malfunctioning subsystems.

Conclusion, Ramifications, and Scope

Accordingly, the reader will see that in the case of damage to the structure to be protected, such as that due to earthquakes, explosions, terrorist attacks, or other substantial damage, including failures to parts of the fire suppression system itself, the present invention holds great advantage over prior art. This is due to: autonomy of damage sensing, and compensation thereof; automatic retardant sharing between nodes; redundancies and spatial separation of sharing paths; selective sealing of sharing paths and isolation of reservoirs; a network of imbricated sensors; redundancy of sensors and controlling subsystems; and, where applicable, use of gravity to supply retardant from all available higher reservoirs.

The combination of control signals (manual or automatic), fire sensors, retardant level sensors, and damage sensors thus cause beneficial retardant flow between reservoirs to extinguish fires; or, isolation of reservoirs in a system-damaged scenario or when retardant sharing is not needed.

While the above description contains many specificities, these should not be construed as limitations on the scope of the invention, but rather as an exemplification of one preferred embodiment thereof. Many other variations are possible. For example, the above description uses as an example a structure with a substantially vertical architecture. Substantially horizontal structures, such as cruise ships or warehouses, can also benefit by alternate embodiments of the invention. Also, water was used as an example of a fire retardant in the above description, but embodiments may use any suitable retardant, such as dry chemicals, foams, inert gases, powdered aerosols, halons, et cetera.

Accordingly, the scope of the invention should be determined not by the embodiment(s) illustrated, but by the appended claims and their legal equivalents.

I claim:

1. A fire suppression system for detecting and suppressing fires in a protected space, comprising:

(a) a plurality of reservoirs, each said reservoir containing a fire retardant;

(b) a piping network, selectably providing fluid communication between said plurality of reservoirs, and to a plurality of sprinklers, each said sprinkler being associated with a first predetermined localized portion of the protected space;

(c) at least one valve;

(d) at least one damage sensor indicative of physical damage to at least one of the piping network, the reservoirs, or the at least one valve; and (e) at least one fire detector, said at least one fire detector associated with a second predetermined localized portion of said protected space.

2. The fire suppression system recited in claim 1, wherein said at least one valve may be closed to selectively isolate segments of said piping network.

3. The fire suppression system recited in claim 1, wherein said at least one valve may be opened to form a path through said piping network for said fire retardant to be selectably shared among said plurality of retardant reservoirs.

4. The fire suppression system recited in claim 1, wherein said piping network comprises at least two flow paths.

5. The fire suppression system recited in claim 1, and further comprising a control station, said control station being operative to control at least one of said at least one valve.

6. The fire suppression system recited in claim 1, and further comprising a control station, said control station comprising system status monitor displays.

7. The fire suppression system recited in claim 1, and further comprising a plurality of control stations, said plurality of control stations being redundantly disposed, and said control stations comprising system status monitor displays, and said control stations being operative to close and open said at least one valve.

8. The fire suppression system recited in claim 1, wherein said piping network comprises at least one first flow path and at least one second flow path, said at least one first flow path being spatially separated from said at least one second flow path.

9. The fire suppression system recited in claim 1, wherein said fire retardant is water.

10. The fire suppression system recited in claim 1, wherein said fire retardant is pressurized.

11. The fire suppression system recited in claim 1, wherein said fire retardant comprises at least one of: a dry chemical, a foam, an inert gas, a powdered aerosol, or a halon.

12. The fire suppression system recited in claim 1, wherein said at least one fire detector comprises at least one of: a smoke detector; a carbon dioxide detector; a thermal sensor; a spectrometer; a chromatograph; a flame-reactive device; a humidity sensor; or a camera.

13. The fire suppression system recited in claim 1, wherein a plurality of said at least one fire detector are disposed throughout the protected space and interconnected in an imbricate topology.

14. The fire suppression system recited in claim 1, wherein said at least one valve comprises at least one of: a manually operable valve; an electrically operable valve; or a hydraulically operable valve.

15. The fire suppression system recited in claim 1, and further comprising a means for audible annunciation.

16. The fire suppression system recited in claim 1, wherein the first predetermined localized portion of the protected space and the second predetermined localized portion of the protected space are the same.

17. The fire suppression system recited in claim 1, wherein said at least one fire detector further comprises a sensor data profile evaluator.

18. A fire suppression system for detecting and suppressing fires in a protected space, comprising:

(a) a plurality of reservoirs, each said reservoir containing a fire retardant, and each said reservoir having a retardant level sensor;

(b) a piping network, selectably providing fluid communication between said plurality of reservoirs, and to a plurality of sprinklers, each said sprinkler being associated with a first predetermined localized portion of the protected space;

(c) at least one valve;

(d) at least one damage sensor indicative of physical damage to at least one of the piping network, the reservoirs, or the at least one valve;

(e) at least one fire detector, said fire detector being associated with a second predetermined localized portion of the protected space; and (f) a signaling means, communicating data between said at least one damage sensor, said at least one fire detector, said retardant level sensors, and said at least one valve.

19. The fire suppression system recited in claim 18, wherein said at least one fire detector activates at least one of said plurality of sprinklers when said at least one fire detector detects a fire.

20. The fire suppression system recited in claim 18, wherein said at least one damage sensor closes at least one of said at least one valve, to isolate segments of said piping network.

21. The fire suppression system recited in claim 18, wherein said at least one fire detector is operative to open at least one of said at least one valve, to form a path through said piping network for said fire retardant to be shared among said plurality of retardant reservoirs.

22. The fire suppression system recited in claim 18, wherein said retardant level sensors are operative to open at least one of said at least one valve, to form a path through said piping network for said fire retardant to be shared among said plurality of retardant reservoirs.

23. The fire suppression system recited in claim 18, wherein said piping network comprises at least two flow paths.

24. The fire suppression system recited in claim 18, and further comprising a control station, said control station being operative to override automatic closing and opening of said at least one valve.

25. The fire suppression system recited in claim 18, and further comprising a control station, said control station comprising system status monitor displays.

26. The fire suppression system recited in claim 18, and further comprising a plurality of control stations, said plurality of control stations being redundantly disposed, and said control stations comprising system status monitor displays, and said plurality of control stations being operative to override automatic closing and opening of said at least one valve.

27. The fire suppression system recited in claim 18, wherein said piping network comprises at least one first flow path and at least one second flow path, said at least one first flow path being spatially separated from said at least one second flow path.

28. The fire suppression system recited in claim 18, wherein said fire retardant is water.

29. The fire suppression system recited in claim 18, wherein said fire retardant is pressurized.

30. The fire suppression system recited in claim 18, wherein said fire retardant comprises at least one of: a dry chemical; a foam; an inert gas; a powdered aerosol; or a halon.

31. The fire suppression system recited in claim 18, wherein said at least one fire detector comprises at least one of: a smoke detector; a carbon dioxide detector; a thermal sensor; a spectrometer; a chromatograph; a flame-reactive device; a humidity sensor; or a camera.

32. The fire suppression system recited in claim 18, wherein said at least one fire detector further comprises a sensor data profile evaluator.

33. The fire suppression system recited in claim 18, wherein said signaling means comprises a data signaling network.

34. The fire suppression system recited in claim 18, wherein said signaling means comprises at least one of: an electrical wire; an optical tranceiver; a radio tranceiver; hydraulics; gears; linkages; bi-level voltages; analog voltages; multiplexing; or data packetization.

35. The fire suppression system recited in claim 18, wherein said at least one damage sensor comprises an electrical continuity wire, said electrical continuity wire being run proximate to said piping network.

36. The fire suppression system recited in claim 18, wherein said at least one damage sensor comprises at least one of: a flow sensor; a pressure sensor; a temperature sensor; an electrical sensor; a camera; or a moisture sensor.

37. The fire suppression system recited in claim 18, wherein said retardant level sensor comprises at least one of: a mechanical float; a pressure sensor; a moisture sensor; or an optical sensor.

38. The fire suppression system recited in claim 18, wherein said at least one fire detector and said retardant level sensors are disposed throughout the protected space and interconnected in an imbricate topology.

39. The fire suppression system recited in claim 18, wherein said at least one valve comprises at least one of: an electrically operable valve; a hydraulically operable valve; or a mechanically operable valve.

40. The fire suppression system recited in claim 18, and further comprising a means for audible annunciation.

41. The fire suppression system recited in claim 18, wherein the first predetermined localized portion of the protected space and the second predetermined localized portion of the protected space are the same.

42. A fire suppression system for detecting and suppressing fires in a protected space, comprising:

(a) a plurality of reservoirs, each said reservoir containing a fire retardant;

(b) a piping network, selectably providing fluid communication between said plurality of reservoirs, and to a plurality of sprinklers, each said sprinkler being associated with a first predetermined localized portion of the protected space;

(c) at least one valve;

(d) at least one damage sensor indicative of physical damage to at least one of the piping network, the reservoirs, or the at least one valve;

(e) at least one fire detector, said fire detector being associated with a second predetermined localized portion of the protected space; and (f) a signaling means, communicating data between said at least one damage sensor, said at least one fire detector, and said at least one valve.

43. The fire suppression system recited in claim 42, wherein the first predetermined localized portion of the protected space and the second predetermined localized portion of the protected space are the same.

* * * * *